United States Patent [19]

Campbell

[11] 4,139,663

[45] Feb. 13, 1979

[54] PROCESS FOR APPLYING A SMOOTH COATING OF PLASTICIZED SULFUR COMPOSITION

[75] Inventor: Robert W. Campbell, Lafayette, Calif.

[73] Assignee: Chevron Research Company, San Francisco, Calif.

[21] Appl. No.: 823,808

[22] Filed: Aug. 11, 1977

[51] Int. Cl.[2] ..... B05D 1/02

[52] U.S. Cl. ..... 427/422; 427/421

[58] Field of Search ..... 239/433, 434; 427/421, 427/422; 106/287 SC

[56] References Cited

U.S. PATENT DOCUMENTS

| | | | |
|---|---|---|---|
| 1,751,343 | 3/1930 | Mack | 427/421 |
| 1,894,879 | 1/1933 | Lay | 239/433 X |
| 1,979,649 | 11/1934 | Stephenson | 239/434 X |
| 2,145,027 | 1/1939 | McGrew | 427/421 |
| 2,322,787 | 6/1943 | Brennan | 427/422 |
| 2,504,805 | 4/1950 | Clipson | 239/433 |
| 2,543,320 | 2/1951 | Huntoon et al. | 239/434 X |
| 3,326,098 | 6/1967 | Boettler | 427/422 X |
| 3,342,378 | 9/1967 | Mezoff et al. | 239/433 X |
| 3,823,019 | 7/1974 | Dale et al. | 106/287 SC X |
| 4,026,719 | 5/1977 | Simic | 106/287 SC |

*Primary Examiner*—Shrive P. Beck

*Attorney, Agent, or Firm*—D. A. Newell; John Stoner, Jr.; A. T. Bertolli

[57] ABSTRACT

A process for applying a smooth coating of a plasticized-sulfur composition which comprises:

(1) conducting a continuous stream of a molten plasticized-sulfur coating composition through a flexible conduit to a spray nozzle;

(2) injecting a substantially inert pressurized gas into the conduit proximate to the nozzle at a flow rate such that the ratio of the flow rate of the coating composition in cubic feet per minute to the flow rate of the gas in cubic feet per minute is about 0.02/1 to about 1/1; and (3) spraying the coating composition and the gas from the conduit through the nozzle onto the surface to be coated.

2 Claims, 1 Drawing Figure

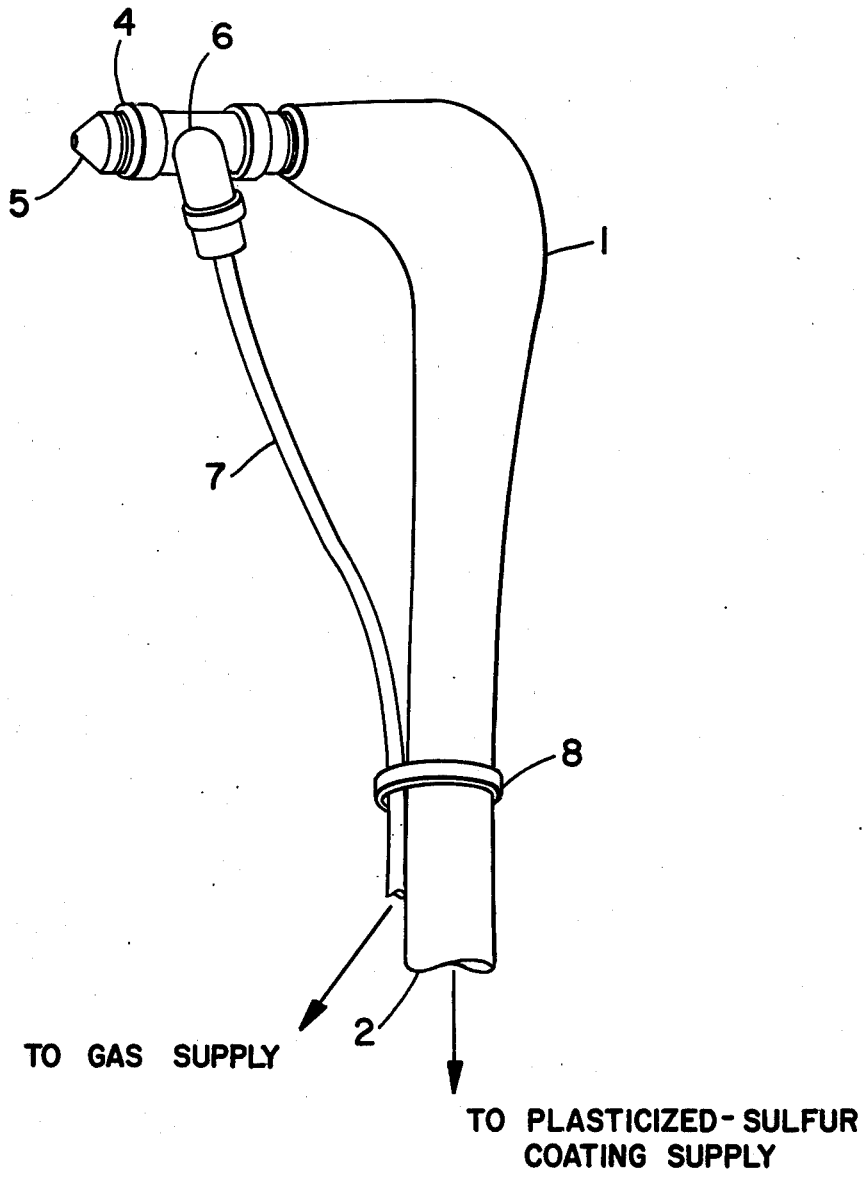
4
6
5
1
7
8
2
TO GAS SUPPLY
TO PLASTICIZED-SULFUR
COATING SUPPLY

PROCESS FOR APPLYING A SMOOTH COATING OF PLASTICIZED SULFUR COMPOSITION

BACKGROUND OF THE INVENTION

This invention concerns a process and apparatus for applying a smooth coating of a plasticized-sulfur based composition. In particular, the process comprises applying a smooth coat of the plasticized-sulfur composition by spraying the composition through a nozzle using a substantially inert pressurized gas to assist the spraying process.

Plasticized-sulfur based coating compositions are well known. For instance, U.S. Pat. Nos. 4,026,719 and 3,823,019 describe coating compositions comprising plasticized-sulfur. The usual method of applying these coating compositions has been to employ a pressurized spraying system. According to U.S. Pat. No. 3,823,019, "An airless spraying system in which the spraying pessure is maintained below about 35 p.s.i. has been found to be very satisfactory. In addition, the use of spray nozzles that create a spray pattern, but do not overly atomize the coating composition are preferred. The use of atomizing air, as employed in conventional paint spray operations is undesirable because of the undue generation of vapors and mist."

However, conventional spray nozzles do not provide a particularly smooth coating. The plasticized-sulfur coating compositions tend to form droplets which, although flattening somewhat upon impact, result in a relatively non-uniform coating. Thus, where aesthetic or other considerations demand a smooth uniform coating, conventional means and apparatus are unsatisfactory. Of course, an experienced technician by regulating the flow rate of the composition and by regulating the rate of application can exercise some control over the appearance of the surface. Nevertheless, a more consistent process for applying smooth coating would be an important advance in the field.

SUMMARY OF THE INVENTION

It has been discovered that an exceptionally smooth uniform coating of plasticized-sulfur compositions can be applied by a process which comprises conducting a continuous stream of molten plasticized-sulfur composition through a flexible conduit to a spray nozzle, injecting a substantially inert pressurized gas into the conduit proximate to the spray nozzle at a flow rate such that the ratio in cubic feet per minute (cfm) of the flow rate of the composition to that cf the gas is from about 0.02/1 to about 1/1, and spraying the composition from the conduit through the nozzle onto the surface to be coated.

BRIEF DESCRIPTION OF THE FIGURE

A preferred embodiment of the apparatus employed in this invention is illustrated in the FIGURE. The apparatus comprises (1) a flexible conduit having a receiving end connected to a source of sulfur coating, a delivering end connected to a spray nozzle, and an inlet located proximate to the delivering end; and (2) a means carried externally on the conduit for conducting a substantially inert pressurized gas to the inlet.

DETAILED DESCRIPTION OF THE INVENTION

Among other factors, the present invention is based upon the surprising discovery that conventional plasticized-sulfur spraying can be gas assisted without causing undue vapors and mist to provide an exceptionally smooth uniform coating, if the ratio of the coating flow rate to the gas flow rate is maintained within a critical range. The ratio in cfm of the coating flow rate to the gas flow rate must be from about 0.02/1 to about 1/1. At a ratio above 1/1 the spraying operation will not provide a smooth coating, that is, there is no advantage to the process. At a ratio below 0.02/1 the coating atomizes generating undue vapors and mist.

Accordingly, this invention provides an improved process for spray coating a plasticized-sulfur composition. In general, any plasticized-sulfur coating composition can be used in this process. These compositions are well known in the art. They are typically prepared by heating sulfur and a sulfur plasticizer above the melting point of the composition to provide a molten composition ready for spraying. Most plasticized-sulfur coating compositions also contain fillers, stabilizers, viscosity increasers, pigment, or similar adjuvants. U.S. Pat. Nos. 4,026,719 and 3,823,019 (incorporated herein by reference) describe typical plasticized-sulfur coating suitable for use in the process of this invention.

The process is carried out using a modified spraying apparatus. A conventional plasticized-sulfur spraying apparatus comprises a conduit attached at one end to a source of coating material and at the other end to a spray nozzle. The modification of this invention involves the use of a means for conducting a substantially inert pressurized gas to an inlet in the spray line so that the gas can be injected into the steam of coating before it reaches the spray nozzle.

The apparatus and process of this invention can be better appreciated by referring to the FIGURE. The apparatus illustrated in the FIGURE comprises a conduit 1 having a receiving end 2 attached to a source of molten plasticized-sulfur coating composition, a delivering end 4 attached to a spray nozzle 5, and an inlet 6. The apparatus also comprises a means 7 of conducting a substantially inert gas to inlet 6. The gas conducting means 7 is carried externally on conduit 1 and is braced by bracket 8.

The source of plasticized-sulfur coating usually comprises a heating vessel which also serves as a mixing vessel for production of the plasticized coating. The size of the vessel is not critical and can range from as small as a 5-gallon can to as large as a 1500-gallon tank. For portability, larger vessels are generally mounted on a wheeled dolly, truck, or trailer. The source also comprises a pumping means to force a regulated amount of the molted plasticized-sulfur from the vessel into conduit 1.

Conduit 1 is generally a flexible insulated hose capable of handling molten plasticized-sulfur compositions. The internal diameter of the conduit is not critical but must provide a controllable spray at flow rates of from about 0.2 cfm to about 2 cfm. A typical hose diameter will be from about ½ inch to 2 inches. The delivering end 4 of conduit 1 is attached to spray nozzle 5. Any of the conventional spray nozzles of the art are suitable, especially those which provide an evenly distributed spray over an arc of about 45°. Inlet 6 is located along the length of conduit 1, generally slightly behind nozzle 5. The exact location and size of the inlet are not critical. Preferably, inlet 6 is positioned about 2 inches behind nozzle 5 and provides an opening of about ¼" diameter. Inlet 6 is connected to a means 7 of conducting a substantially inert pressurized gas to inlet 6.

Typically, conducting means 7 will be a small diameter conduit carried externally on conduit 1. The conducting means is connected to a regulatable source of inlet gas. The gas is then conducted to inlet 6 where it is injected into conduit 1 at a flow rate sufficient to maintain a ratio in cfm of coating flow rate to gas flow rate of from about 0.02/1 to about 1/1, preferably from about 0.04/1 to about 0.4/1. It is essential that the flow rate ratio of coating to gas be within this range.

The apparatus illustrated in the FIGURE works as follows: a continuous stream of molten platicized-sulfur coating composition is forced from the source into conduit 1 through receiving end 2. The coating composition travels the length conduit 1. At inlet 6 a substantially inert gas is injected into conduit 1 from conducting means 7. The flow rates of the coating and the gas are regulated to provide a flow rate ratio in cfm of coating to gas of from 0.02/1 to about 1/1. The coating and gas are passed through delivering end 4 of conduit 1 into spray nozzle 5. A continuous spray of coating and gas is passed from nozzle 5 to provide a uniform smooth coating.

As used herein the term "substantially inert gas" includes those gases which do not react with molten plasticized-sulfur, or only react after a substantial time. Air is a preferred gas. While the precise reasons that the process of this invention provides an exceptionally smooth coating have not been determined, it is believed to be a combination of influences. For instance, the gas is known to cool the molten sulfur to a more viscose state while at the same time reducing the droplet size of the spray.

To illustrate the advantages of the apparatus and process according to this invention, the following comparison was carried out. A plasticized-sulfur coating composition was prepared according to U.S. Pat. No. 4,026,719. The composition comprised 79%, by weight, sulfur; 2%, by weight, phenol sulfur adduct; 1%, by weight, linear aliphatic polysulfide (Thiokol LP-3); and 18%, by weight, mica. A portion of the composition was sprayed at a flow rate of about 16.5 lbs/min. onto the rough surface of a concrete block from a 100 gallon tank using a conventional spray apparatus comprising a 1" diameter hose attached to a flat spray pattern nozzle. The nozzle had a capacity of 1.5 gallons per minute and a spray angle of 40° (rated for water at 40 psi). The resulting coating was relatively non-uniform characterized by intermittent globules of coating through the surface. The spray apparatus was modified by providing an air assist through a ¼" diameter inlet located about 2" from the nozzle orifice. Air at a flow rate ratio in cfm of coating to air of about 0.2/1 was injected into the hose. The spraying operation as repeated. The resulting coating was exceptionally uniform and smooth. No globules of coating were observed.

What is claimed is:

1. A process for applying a smooth coating of a plasticized-sulfur composition without causing undue vapors and mist which comprises:

(1) conducting a continuous stream of molten plasticized-sulfur composition under pressure through a flexible conduit to a spray nozzle;

(2) injecting a substantially inert pressurized gas into said conduit containing said continuous stream of molten plasticized-sulfur composition proximate to said nozzle to form a mixture of said molten plasticized-sulfur composition and said gas in a flow rate ratio from about 0.02:1 to 1:1, the flow rate being measured in cubic feet per minute;

(3) spraying said mixture from said conduit through said nozzle onto the surface to be coated.

2. A process according to claim 1 wherein the flow rate ratio is from about 0.04:1 to 0.4:1.

* * * * *